US010955149B2

(12) United States Patent
Shi

(10) Patent No.: US 10,955,149 B2
(45) Date of Patent: Mar. 23, 2021

(54) DEHUMIDIFICATION SYSTEM FOR HEAT PUMP

(71) Applicant: Carrier Corporation, Palm Beach Gardens, FL (US)

(72) Inventor: Zuojun Shi, Marcellus, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 54 days.

(21) Appl. No.: 16/320,365

(22) PCT Filed: Jul. 25, 2017

(86) PCT No.: PCT/US2017/043759
§ 371 (c)(1),
(2) Date: Jan. 24, 2019

(87) PCT Pub. No.: WO2018/022638
PCT Pub. Date: Feb. 1, 2018

(65) Prior Publication Data

US 2019/0264932 A1 Aug. 29, 2019

Related U.S. Application Data

(60) Provisional application No. 62/366,356, filed on Jul. 25, 2018.

(51) Int. Cl.
*F24F 3/153* (2006.01)
*F25B 6/04* (2006.01)
*F25B 41/04* (2006.01)

(52) U.S. Cl.
CPC ..... *F24F 3/153* (2013.01); *F25B 6/04* (2013.01); *F25B 41/046* (2013.01); *F25B 2313/0212* (2013.01); *F25B 2600/05* (2013.01)

(58) Field of Classification Search
CPC ..... F24F 3/153; F25B 30/02; F25B 41/046; F25B 2313/0212; F25B 2600/05; F25B 2700/02; F25B 6/04
See application file for complete search history.

(56) References Cited

U.S. PATENT DOCUMENTS 5,404,729 A 4/1995 Matsuoka et al.
5,689,962 A 11/1997 Rafalovich
(Continued)

FOREIGN PATENT DOCUMENTS

CN 1961186 A 5/2007
CN 102635905 A 8/2012
(Continued)

OTHER PUBLICATIONS

International Search Report and Written Opinion for application PCT/US2017/043759, dated Oct. 2, 2017 , 13 pages.
(Continued)

*Primary Examiner* — Marc E Norman
(74) *Attorney, Agent, or Firm* — Cantor Colburn LLP

(57) ABSTRACT

A dehumidification system for a heat pump, a method of operating a heat pump system, and a method of operating a refrigeration system are provided. The method of operating a heat pump system includes circulating refrigerant in a refrigerant circuit having a compressor (12), selectively communicating refrigerant from the compressor to an indoor heat exchanger (18) during a heating mode or to an outdoor heat exchanger (16) during a cooling mode or a reheat mode, selectively communicating refrigerant to a reheat heat exchanger during the reheat mode, and regulating a refrigerant volume in the reheat heat exchanger.

15 Claims, 12 Drawing Sheets

(56) References Cited

U.S. PATENT DOCUMENTS

| | | | | |
|---|---|---|---|---|
| 6,826,921 | B1 | 12/2004 | Uselton | |
| 7,185,506 | B2 | 3/2007 | Aflekt et al. | |
| 7,287,581 | B2 | 10/2007 | Ziehr et al. | |
| 7,290,399 | B2 | 11/2007 | Taras et al. | |
| 7,823,404 | B2 | 11/2010 | Hanson | |
| 2005/0115254 | A1 | 6/2005 | Knight et al. | |
| 2008/0098756 | A1 | 5/2008 | Uselton | |
| 2008/0196426 | A1 | 8/2008 | Taras et al. | |
| 2011/0079032 | A1* | 4/2011 | Taras | F28D 1/05391 62/113 |
| 2011/0100035 | A1 | 5/2011 | Taras et al. | |
| 2013/0312447 | A1 | 11/2013 | Inaba et al. | |
| 2015/0013356 | A1 | 1/2015 | Karkhanis et al. | |
| 2016/0146477 | A1 | 5/2016 | Jewell et al. | |

FOREIGN PATENT DOCUMENTS

| | | | |
|---|---|---|---|
| JP | H0268467 | A | 3/1990 |
| JP | H05203274 | A | 8/1993 |
| JP | H0634219 | A | 2/1994 |
| JP | 2010101588 | A | 5/2010 |
| KR | 100865139 | B1 | 10/2008 |

OTHER PUBLICATIONS

Rudd, Armin, "Advanced Central Cooling System with Dehumidification Mode", Building America Report 0506, Dec. 22, 2005, 25 pages.

Chinese Office Action for Application No. 201780046330.6; dated Jul. 2, 2020; 7 Pages.

* cited by examiner

DEHUMIDIFICATION SYSTEM FOR HEAT PUMP

CROSS-REFERENCE TO RELATED APPLICATION

The present application is an international patent application, which claims the priority benefit of U.S. Patent Application Ser. No. 62/366,356, filed Jul. 25, 2016, the text and drawings of which are hereby incorporated by reference in their entireties.

TECHNICAL FIELD OF THE DISCLOSED EMBODIMENTS

The presently disclosed embodiments generally relate to a dehumidification system and, more particularly, to a dehumidification system for a heat pump.

BACKGROUND OF THE DISCLOSED EMBODIMENTS

Heat pump systems may generally operate in a cooling mode or heating mode. Typically, in a cooling mode, a refrigerant is compressed in a compressor and delivered to an outdoor heat exchanger. In the outdoor heat exchanger, heat is exchanged between outside ambient air and the refrigerant. From the outdoor heat exchanger, the refrigerant passes to an expansion device in which the refrigerant is expanded to a lower pressure and temperature, and then to an indoor heat exchanger. In the indoor heat exchanger, heat is exchanged between the refrigerant and the indoor air to condition the indoor air. In the heating mode, the refrigerant flow through the system is essentially reversed. The indoor heat exchanger becomes the condenser and releases heat into the environment, and the outdoor heat exchanger becomes the evaporator and exchanges heat with a relatively cold outdoor air.

In heat pump systems, depending on environmental and operating conditions, a target indoor air temperature may be below an ideal temperature in order to provide an ideal humidity level. In such situations, reheat heat exchangers, such as reheat coils, may be utilized to reheat the air and approach an ideal temperature. A reheat heat exchanger may be placed in the path of the indoor air stream downstream from the indoor heat exchanger to raise the air temperature after it has been cooled for moisture removal.

SUMMARY OF THE DISCLOSED EMBODIMENTS

In accordance with an embodiment of the present disclosure, a dehumidification system for a heat pump is provided. The system includes a compressor configured to circulate refrigerant in a refrigerant circuit, an outdoor heat exchanger, an indoor heat exchanger, a flow control device for selectively routing refrigerant from the compressor to the indoor heat exchanger when in a heating mode or to the outdoor heat exchanger when in a cooling mode, and a reheat heat exchanger configured to receive refrigerant during a reheat mode and regulate a refrigerant volume during an initiation of the heating mode and the cooling mode.

The reheat heat exchanger may be configured to receive and store the refrigerant volume for a predetermined time period during the initiation of the heating mode or the cooling mode before refrigerant bypasses the reheat heat exchanger. The system may further include a bleed passage selectively communicating refrigerant from the reheat heat exchanger in the heating mode or cooling mode. The bleed passage may selectively communicate refrigerant to a location upstream from the compressor. The system may further include an outdoor heat exchanger bypass device to selectively control refrigerant bypass of the outdoor heat exchanger.

A method of operating a heat pump system is provided. The method includes the steps of circulating refrigerant in a refrigerant circuit having a compressor, selectively communicating refrigerant from the compressor to an indoor heat exchanger during a heating mode or to an outdoor heat exchanger during a cooling mode or a reheat mode, selectively communicating refrigerant to a reheat heat exchanger during the reheat mode, and regulating a refrigerant volume in the reheat heat exchanger.

Regulating the refrigerant volume may include bypassing the reheat heat exchanger after receiving and storing the refrigerant volume for a predetermined time period during initiation of the heating mode or the cooling mode. Regulating the refrigerant volume may include bleeding refrigerant from the reheat heat exchanger during the heating mode or the cooling mode. Bleeding refrigerant from the reheat heat exchanger may include bleeding refrigerant from the reheat heat exchanger to a location upstream from the compressor. The method may include selectively bypassing the outdoor heat exchanger.

In accordance with an embodiment of the present disclosure, a method of operating a refrigeration system is provided. The method includes the steps of circulating refrigerant in a refrigerant circuit, cooling indoor air with an outdoor heat exchanger and an indoor heat exchanger in a cooling mode, cooling and dehumidifying air with the outdoor heat exchanger, the indoor heat exchanger, and a reheat heat exchanger in a reheat mode, and regulating a refrigerant volume in the reheat heat exchanger during the cooling mode.

Regulating the refrigerant volume may include the refrigerant bypassing the reheat heat exchanger after receiving and storing the refrigerant volume for a predetermined time period during initiation of the heating mode or the cooling mode. Regulating the refrigerant volume may include bleeding refrigerant from the reheat heat exchanger in the cooling mode. Bleeding refrigerant from the reheat heat exchanger may include bleeding refrigerant from the reheat heat exchanger to a location upstream from a compressor. The method may include heating indoor air in a heating mode and regulating the refrigerant volume in the reheat heat exchanger during the heating mode. Regulating the refrigerant volume may include the refrigerant bypassing the reheat heat exchanger after receiving and storing the refrigerant volume for a predetermined time period during initiation of the heating mode. Regulating the refrigerant volume may include removing refrigerant from the reheat heat exchanger in the heating mode. Removing refrigerant from the reheat heat exchanger may include bleeding refrigerant from the reheat heat exchanger to a location upstream from a compressor. The method further includes selectively bypassing the outdoor heat exchanger.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE ENCLOSED EMBODIMENTS

Figure 1:
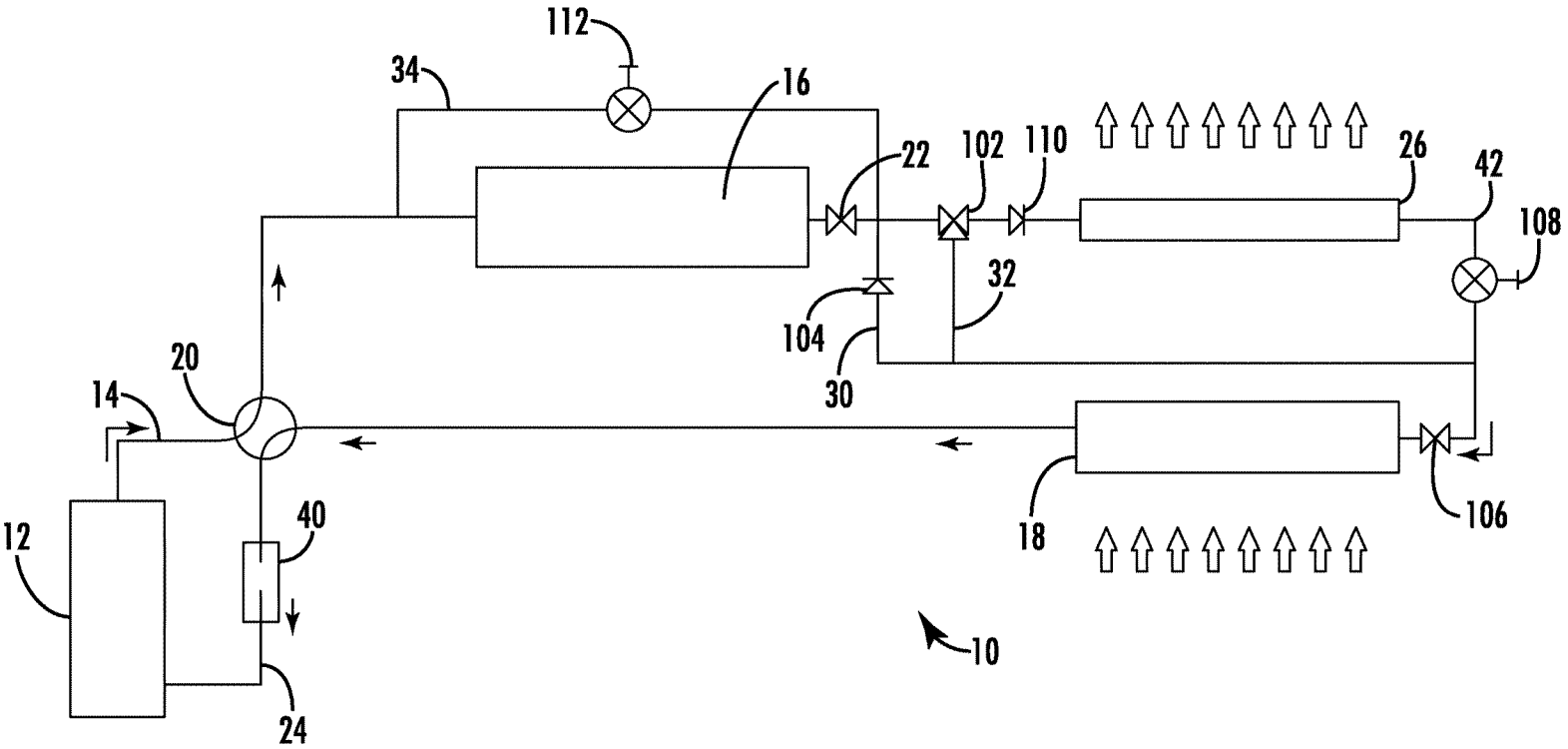
FIG. 1 illustrates a dehumidification system for a heat pump according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring now to the drawings, FIG. 1 illustrates a heat pump system 10 in accordance with one embodiment. The heat pump system 10 includes a compressor 12 delivering refrigerant to a discharge line 14 and generally configured to circulate refrigerant in a refrigerant circuit. A suction line 24 returns refrigerant to the compressor 12. An accumulator 40, or similar device well known by those of ordinary skill in the art, is provided in the system 10 in direct communication with the suction line 24 for the purpose of preventing compressor damage from a sudden surge of liquid refrigerant and oil that could enter the compressor 12 from the suction line 12. The system 10 further includes an outdoor heat exchanger 16 and an indoor heat exchanger 18 disposed in the refrigerant circuit. A flow control device 20, such as a reversing valve, a four-way valve, or an equivalent device in non-limiting examples, selectively routes refrigerant from the discharge line 14 of the compressor 12 to the indoor heat exchanger 18 when operating in a heating mode, as illustrated in FIG. 2, or to the outdoor heat exchanger 16 when operating in a cooling mode, as illustrated in FIG. 1.

In the cooling mode illustrated in FIG. 1, the refrigerant circuit is configured such that the flow control device 20 routes the refrigerant through the outdoor heat exchanger 16 to a reheat valve 102. The expansion device 22 illustrated in FIG. 1 is bypassed in the cooling mode and the reheat mode, such as with a check valve or other device (not shown), to prevent premature evaporation as known by those having ordinary skill in the art.

The reheat valve 102 routes the refrigerant through line 32, then through expansion device 106 through the indoor heat exchanger 18. The refrigerant evaporates as it passes through the indoor heat exchanger 18 as air passes over the indoor heat exchanger 18, thereby delivering cool air to an interior space. The refrigerant is then returned through the flow control device 20 and suction line 24 back to the compressor 12. Reheat valve 102, or any other control valve described in the present disclosure, may be a three way valve in an embodiment, and may be one or more solenoid valves, check valves, or any similar devices known by a person having ordinary skill in the art in additional embodiments. The expansion device 106, or any other expansion device described in the present disclosure, is a modulating expansion valve, and is one or more venturis, capillary tubes, or any similar devices known by a person having ordinary skill in the art in additional embodiments.

Figure 2:
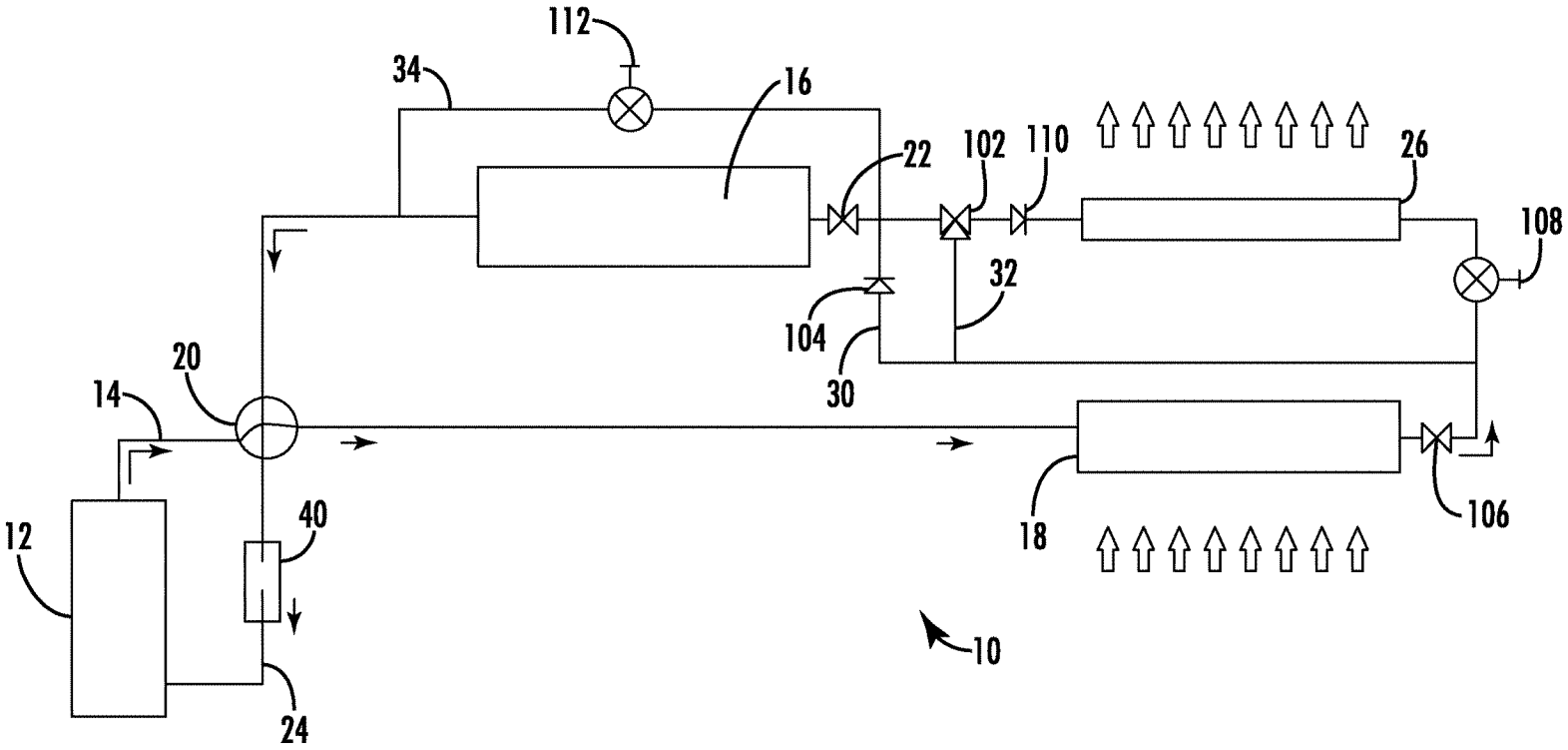
FIG. 2 illustrates a dehumidification system for a heat pump according to one embodiment of the present disclosure.

Referring now to FIG. 2, in the heating mode, a direction of the refrigerant flow through the system 10 is essentially reversed, and the refrigerant flows from the compressor 12, through the discharge line 14 and the flow control device 20, and through the indoor heat exchanger 18, the expansion valve 106, and the valve 104 of line 30. Refrigerant then flows through the main expansion device 22 to the outdoor heat exchanger 16, before flowing again through the flow control device 20 and through the suction line 24 back to the compressor 12. The refrigerant condenses as it passes through the indoor heat exchanger 18 as indoor air passes over the indoor heat exchanger 18, thereby delivering warm air to an interior space.

As can be seen in the FIGS. 1 and 2, the flow control device 20 is controlled to either achieve a cooling mode or a heating mode of operation. The main expansion device 22 in one or more embodiments is one or more modulating expansion valves, capillary tubes, venturi devices, or any equivalent devices with or without a check valve as recognized by a person having ordinary skill in the art.

The system 10 further includes an outdoor heat exchanger bypass device 112 to selectively control bypass of refrigerant around the outdoor heat exchanger 16 through the outdoor bypass line 34. Bypass of the outdoor heat exchanger 16 occurs based on predetermined design criteria, such as a target reheat heat exchanger temperature in a non-limiting example, to maintain a higher temperature refrigerant flowing to a reheat heat exchanger 26 as needed, as understood by one having ordinary skill in the art. The system 10 is configured to operate in a reheat mode provided by the reheat heat exchanger 26. In one embodiment, the reheat heat exchanger 26 is disposed inside the indoor heat exchanger 18. In another embodiment, the reheat heat exchanger 26 is disposed inside a fan coil (not shown). In another embodiment, the reheat heat exchanger 26 is disposed as a separate unit coupled to or spaced from the indoor heat exchanger 18 and the fan coil. The reheat valve 102, such as a three way valve or any equivalent device or multiple equivalent devices in non-limiting examples, is controlled by a controller (not shown) in the heat pump system 10, and selectively delivers refrigerant through the reheat heat exchanger 26 when the reheat mode is desired. The reheat mode is desired, in one embodiment, when a humidity level is above a predetermined threshold and a refrigerant temperature required to reduce the humidity level at the indoor heat exchanger 18 is below a target air temperature. The reheat heat exchanger 26 is positioned to be in air flow communication with the indoor heat exchanger 18, such that air is directed over both the indoor heat exchanger 18 and the reheat heat exchanger 26. The reheat heat exchanger 26 is operated when dehumidification is desired and, in many cases, when the air needs to be reheated after leaving indoor heat exchanger 18 to improve the indoor air comfort. At least a portion of that air then passes over the reheat heat exchanger 26 where its temperature rises. The reheat heat exchanger 26 is configured to receive refrigerant during the reheat mode. Reheat valve 102 selectively controls the flow of refrigerant through line 42 and the reheat heat exchanger 26, such as during reheat mode. A controller (not shown) controls the reheat valve 102 in accordance with a control algorithm by opening the line 42 for refrigerant to flow to the reheat heat exchanger 26 while closing the line 32 to prevent refrigerant from bypassing the reheat heat exchanger 26. Valve 110 is provided to prevent reverse flow of the refrigerant during the reheat mode.

During certain heating modes and cooling modes where refrigerant is not circulated through the reheat heat exchanger, a volume of refrigerant may remain in the reheat heat exchanger or the refrigerant lines adjacent the reheat heat exchanger. In such cases, refrigerant retained in the reheat heat exchanger or the refrigerant lines adjacent the reheat heat exchanger may reduce the efficiency and/or performance of the heat pump system.

Therefore, there remains a need for a dehumidification system for a heat pump that selectively controls a volume of refrigerant in the reheat heat exchanger or the refrigerant lines adjacent the reheat heat exchanger to improve a heat pump system efficiency and/or performance. Further, there exists a need for a method of operating a heat pump system that includes regulating a volume of refrigerant in the reheat heat exchanger or the refrigerant lines adjacent the reheat heat exchanger to improve a heat pump system efficiency and/or performance.

In embodiments of the present disclosure, the system 10 regulates a refrigerant volume in the reheat heat exchanger 26 during the heating mode and the cooling mode. The system 10 regulates a refrigerant volume in the reheat heat exchanger 26 in particular embodiments by circulating refrigerant sequentially through the outdoor heat exchanger 16 and the reheat heat exchanger 26 for a predetermined period of time upon initiation of the heating or cooling mode, as explained in further detail below.

In accordance with the embodiments illustrated in FIGS. 1 and 2, the reheat heat exchanger 26 is configured, upon initial operation of the heating or cooling mode, to receive refrigerant for a predetermined time period in the heating mode or the cooling mode before the refrigerant bypasses the reheat heat exchanger 26. Valve 108 is open for the predetermined time period upon initial operation of the heating or cooling mode in an embodiment to allow the reheat heat exchanger 26 to receive and store a volume of refrigerant before reheat valve 102 closes to allow refrigerant to bypass the reheat heat exchanger 26. The outdoor heat exchanger bypass device 112 is closed and device 20 routes refrigerant to the outdoor heat exchanger 16 during the predetermined time period of the initial operation of the heating or cooling mode to allow refrigerant to condense and the reheat heat exchanger 26 to receive and store a reliably consistent volume of liquid refrigerant in an embodiment. In one embodiment, the predetermined time period is five minutes. In another embodiment, the predetermined time period is between two minutes and ten minutes. In another embodiment, the predetermined time period is less than two minutes. In another embodiment, the predetermined time period is greater than ten minutes. In such embodiments, refrigerant is allowed to circulate into and substantially completely fill the reheat heat exchanger 26 before refrigerant is controlled to bypass the reheat heat exchanger 26. The system 10 then operates using a predetermined and consistent volume of refrigerant to improve efficient, performance, and reliability.

In an additional embodiment, the outdoor heat exchanger bypass device 112 selectively controls bypass of refrigerant around the outdoor heat exchanger 16 through the outdoor bypass line 34 in the reheat mode. Upon the system 10 meeting a desired target, the device 112 is closed for a predetermined time period before ending the reheat mode. In one embodiment, the predetermined time period is five minutes. In another embodiment, the predetermined time period is between two minutes and ten minutes. In another embodiment, the predetermined time period is less than two minutes. In another embodiment, the predetermined time period is greater than ten minutes. In other words, the system 10 continues to run in the reheat mode for the predetermined time period while the device 112 is closed. In such embodiments, refrigerant is allowed to circulate into and substantially completely fill the reheat heat exchanger 26 before the refrigerant is controlled to bypass the reheat heat exchanger 26 in the next mode, such as the cooling mode or the heating mode. The system 10 then operates using a predetermined and consistent volume of refrigerant to improve efficiency, performance, and reliability.

Figure 3:
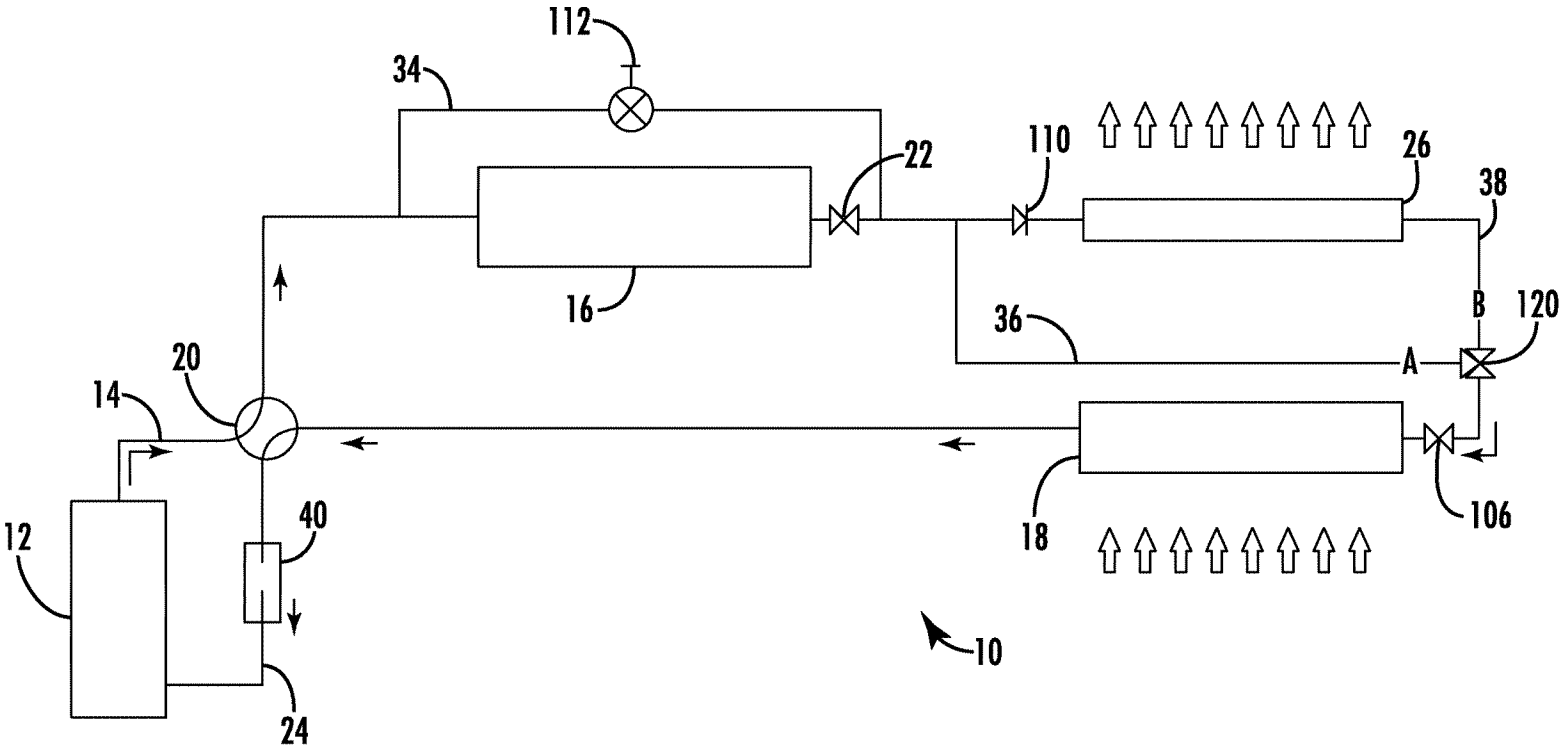
FIG. 3 illustrates a dehumidification system for a heat pump according to one embodiment of the present disclosure.
Figure 4:
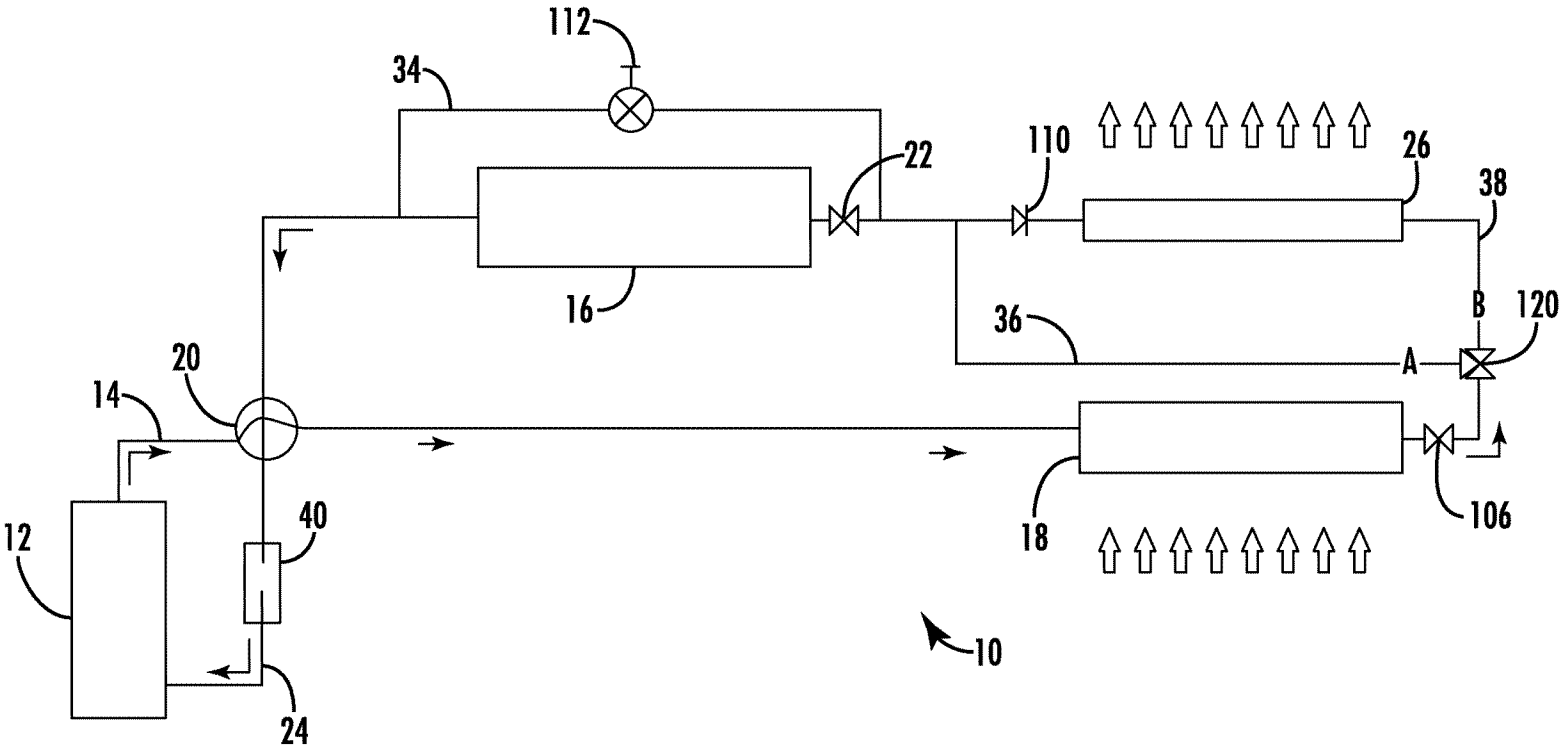
FIG. 4 illustrates a dehumidification system for a heat pump according to one embodiment of the present disclosure.

Referring now to FIGS. 3 and 4, in accordance with another embodiment of the present disclosure, the system 10 includes a reheat valve 120, such as a three way valve or any equivalent device or multiple equivalent devices in non-limiting examples, which selectively delivers refrigerant through the reheat heat exchanger 26 when the reheat function is desired. In one embodiment, the reheat valve 120 is similar to or identical in construction or operation to the reheat valve 102 illustrated in FIGS. 1 and 2. In the cooling mode, illustrated in FIG. 3, the reheat valve 120 is opened to line 36 and closed to line 38. In the reheat mode, the reheat valve 120 is open to line 38 to allow refrigerant to circulate through the reheat heat exchanger 26 and closed to line 36. In the heating mode, as illustrated in FIG. 4, the reheat valve 120 is open to line 36 to allow refrigerant to bypass the reheat heat exchanger 26.

In embodiments of the present disclosure illustrated in FIGS. 3 and 4, the system 10 regulates a refrigerant volume in the reheat heat exchanger 26 during the heating mode and the cooling mode. Regulation of a refrigerant volume in the reheat heat exchanger 26 in particular embodiments includes circulating refrigerant sequentially through the outdoor heat exchanger 16 and the reheat heat exchanger 26 for a predetermined period of time upon initiation of the heating or cooling mode and/or removing refrigerant from the reheat heat exchanger 26 during operation of the heating or cooling mode, as explained in further detail below.

In accordance with the embodiments illustrated in FIGS. 3 and 4, the reheat heat exchanger 26 is configured, upon initial operation of the heating or cooling mode, to receive refrigerant for a predetermined time period in the heating mode or the cooling mode before the refrigerant bypasses the reheat heat exchanger 26. The reheat valve 120 is open to line 38 and closed to line 36 during the predetermined time period upon initial operation of the heating or cooling mode in an embodiment to allow the reheat heat exchanger 26 to receive and store a volume of refrigerant before reheat valve 120 closes to line 38 and opens to line 36 to allow refrigerant to bypass the reheat heat exchanger 26. The outdoor heat exchanger bypass device 112 is closed and device 20 routes refrigerant to the outdoor heat exchanger 16 during the predetermined time period of the initial operation of the heating or cooling mode to allow refrigerant to condense and the reheat heat exchanger 26 to receive and store a reliably consistent volume of liquid refrigerant in an embodiment. In one embodiment, the predetermined time period is five minutes. In another embodiment, the predetermined time period is between two minutes and ten minutes. In another embodiment, the predetermined time period is less than two minutes. In another embodiment, the predetermined time period is greater than ten minutes. In such embodiments, refrigerant is allowed to circulate into and substantially completely fill the reheat heat exchanger 26 before refrigerant is controlled to bypass the reheat heat exchanger 26. The system 10 then operates using a predetermined and consistent volume of refrigerant to improve efficient, performance, and reliability.

In an additional embodiment, the outdoor heat exchanger bypass device 112 selectively controls bypass of refrigerant around the outdoor heat exchanger 16 through the outdoor bypass line 34 in the reheat mode. Upon the system 10 meeting a desired target, the device 112 is closed for a predetermined time period before ending the reheat mode. In one embodiment, the predetermined time period is five minutes. In another embodiment, the predetermined time period is between two minutes and ten minutes. In another embodiment, the predetermined time period is less than two minutes. In another embodiment, the predetermined time period is greater than ten minutes. In other words, the system 10 continues to run in the reheat mode for the predetermined time period while the device 112 is closed. In such embodiments, refrigerant is allowed to circulate into and substantially completely fill the reheat heat exchanger 26 before the refrigerant is controlled to bypass the reheat heat exchanger 26 in the next mode, such as the cooling mode or the heating mode. The system 10 then operates using a predetermined and consistent volume of refrigerant to improve efficiency, performance, and reliability.

Figure 5:
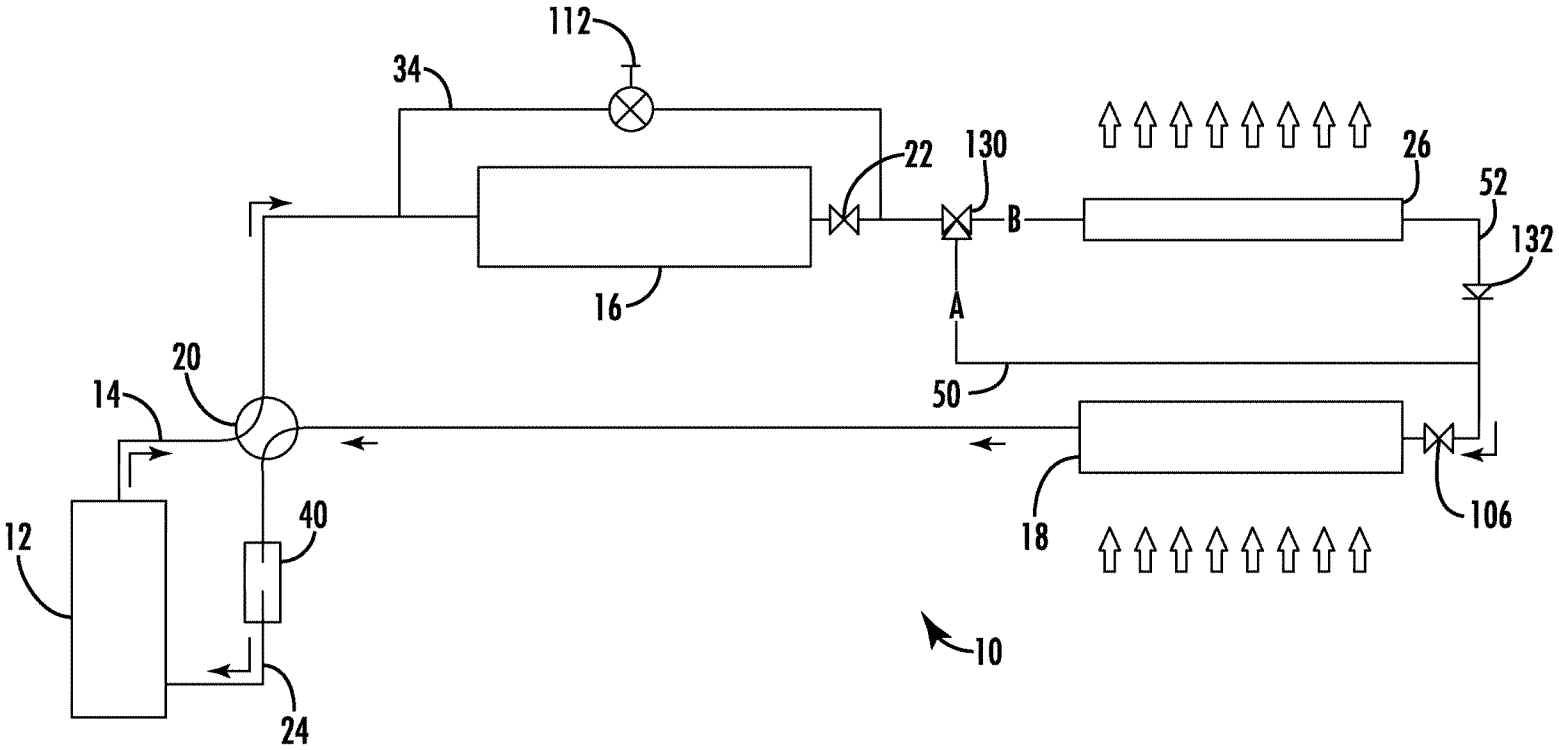
FIG. 5 illustrates a dehumidification system for a heat pump according to one embodiment of the present disclosure.
Figure 6:
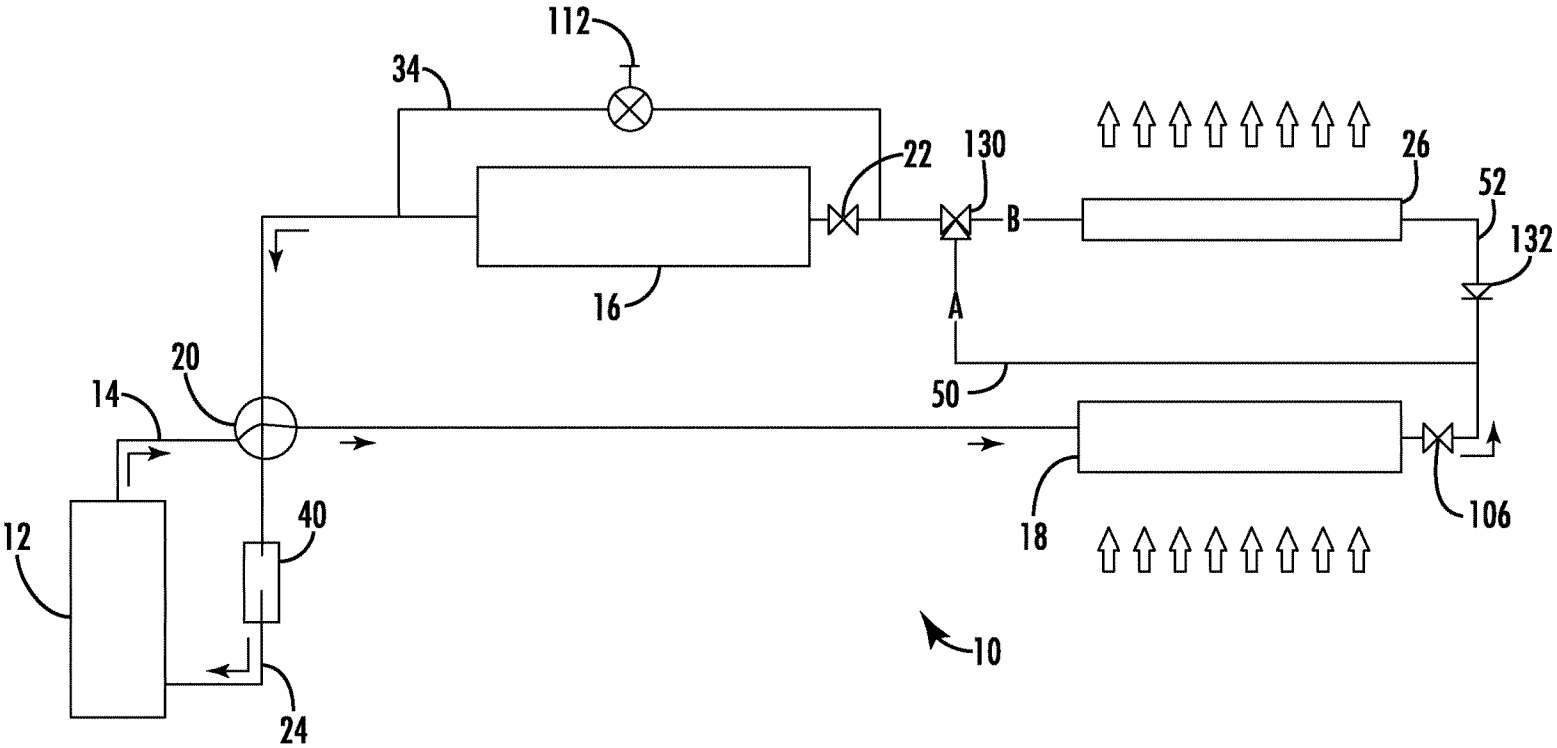
FIG. 6 illustrates a dehumidification system for a heat pump according to one embodiment of the present disclosure.

Referring now to FIGS. 5 and 6, in accordance with another embodiment of the present disclosure, the system 10 includes a reheat valve 130, such as a three way valve or any equivalent device or multiple equivalent devices in non-limiting examples, which selectively delivers refrigerant through the reheat heat exchanger 26 when the reheat function is desired. In one embodiment, the reheat valve 130 is similar to or identical in construction or operation to the reheat valve 102 illustrated in FIGS. 1 and 2 or the reheat valve 120 in FIGS. 3 and 4. In the cooling mode, illustrated in FIG. 5, the reheat valve 130 is opened to line 50 and closed to line 52. In the reheat mode, the reheat valve 130 is open to line 52 to allow refrigerant to circulate through the reheat heat exchanger 26 and closed to line 50. In the heating mode, as illustrated in FIG. 6, the reheat valve 130 is open to line 50 to allow refrigerant to bypass the reheat heat exchanger 26.

In embodiments of the present disclosure illustrated in FIGS. 5 and 6, the system 10 regulates a refrigerant volume in the reheat heat exchanger 26 during the heating mode and the cooling mode. In accordance with the embodiments illustrated in FIGS. 5 and 6, the reheat heat exchanger 26 is configured to receive refrigerant for a predetermined time period in the heating mode or the cooling mode before the refrigerant bypasses the reheat heat exchanger 26. The reheat valve 130 is open to line 52 and closed to line 50 during the predetermined time period upon initial operation of the heating or cooling mode in an embodiment to allow the reheat heat exchanger 26 to receive and store a volume of refrigerant before reheat valve 130 closes to line 52 and opens to line 50 to allow refrigerant to bypass the reheat heat exchanger 26. The outdoor heat exchanger bypass device 112 is closed and device 20 routes refrigerant to the outdoor heat exchanger 16 during the predetermined time period of the initial operation of the heating or cooling mode to allow refrigerant to condense and the reheat heat exchanger 26 to receive and store a reliably consistent volume of liquid refrigerant in an embodiment. In one embodiment, the predetermined time period is five minutes. In another embodiment, the predetermined time period is between two minutes and ten minutes. In another embodiment, the predetermined time period is less than two minutes. In another embodiment, the predetermined time period is greater than ten minutes. In such embodiments, refrigerant is allowed to circulate into and substantially completely fill the reheat heat exchanger 26 before refrigerant is controlled to bypass the reheat heat exchanger 26. Valve 132, which includes a check valve, solenoid valve, or similar valve in one or more non-limiting examples, is provided to retain refrigerant in the reheat heat exchanger 26 in the line 52. The system 10 then operates using a predetermined and consistent volume of refrigerant to improve efficient, performance, and reliability.

In an additional embodiment, the outdoor heat exchanger bypass device 112 selectively controls bypass of refrigerant around the outdoor heat exchanger 16 through the outdoor bypass line 34 in the reheat mode. Upon the system 10 meeting a desired target, the device 112 is closed for a predetermined time period before ending the reheat mode. In one embodiment, the predetermined time period is five minutes. In another embodiment, the predetermined time period is between two minutes and ten minutes. In another embodiment, the predetermined time period is less than two minutes. In another embodiment, the predetermined time period is greater than ten minutes. In other words, the system 10 continues to run in the reheat mode for the predetermined time period while the device 112 is closed. In such embodiments, refrigerant is allowed to circulate into and substantially completely fill the reheat heat exchanger 26 before the refrigerant is controlled to bypass the reheat heat exchanger 26 in the next mode, such as the cooling mode or the heating mode. The system 10 then operates using a predetermined and consistent volume of refrigerant to improve efficiency, performance, and reliability.

Figure 7:
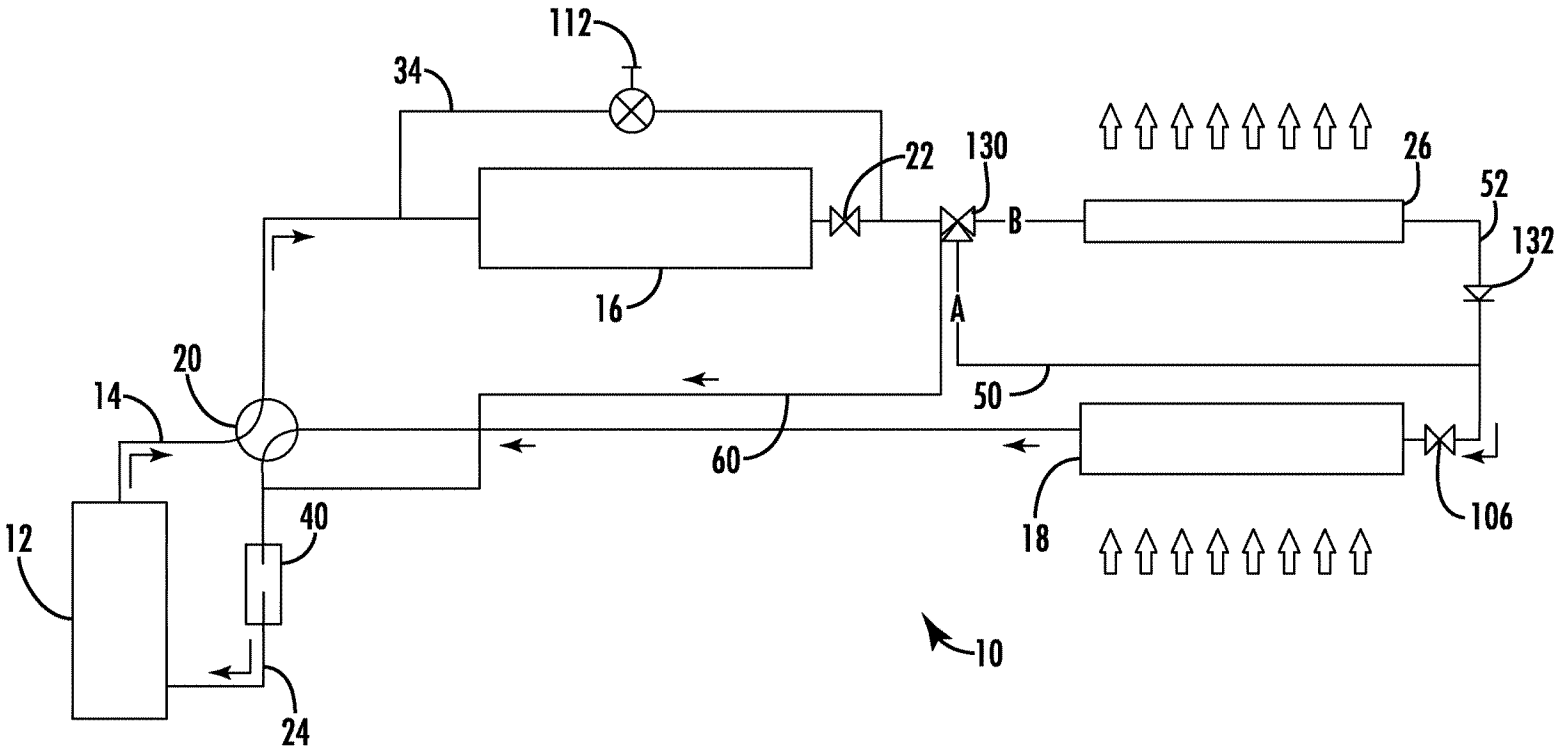
FIG. 7 illustrates a dehumidification system for a heat pump according to one embodiment of the present disclosure.
Figure 8:
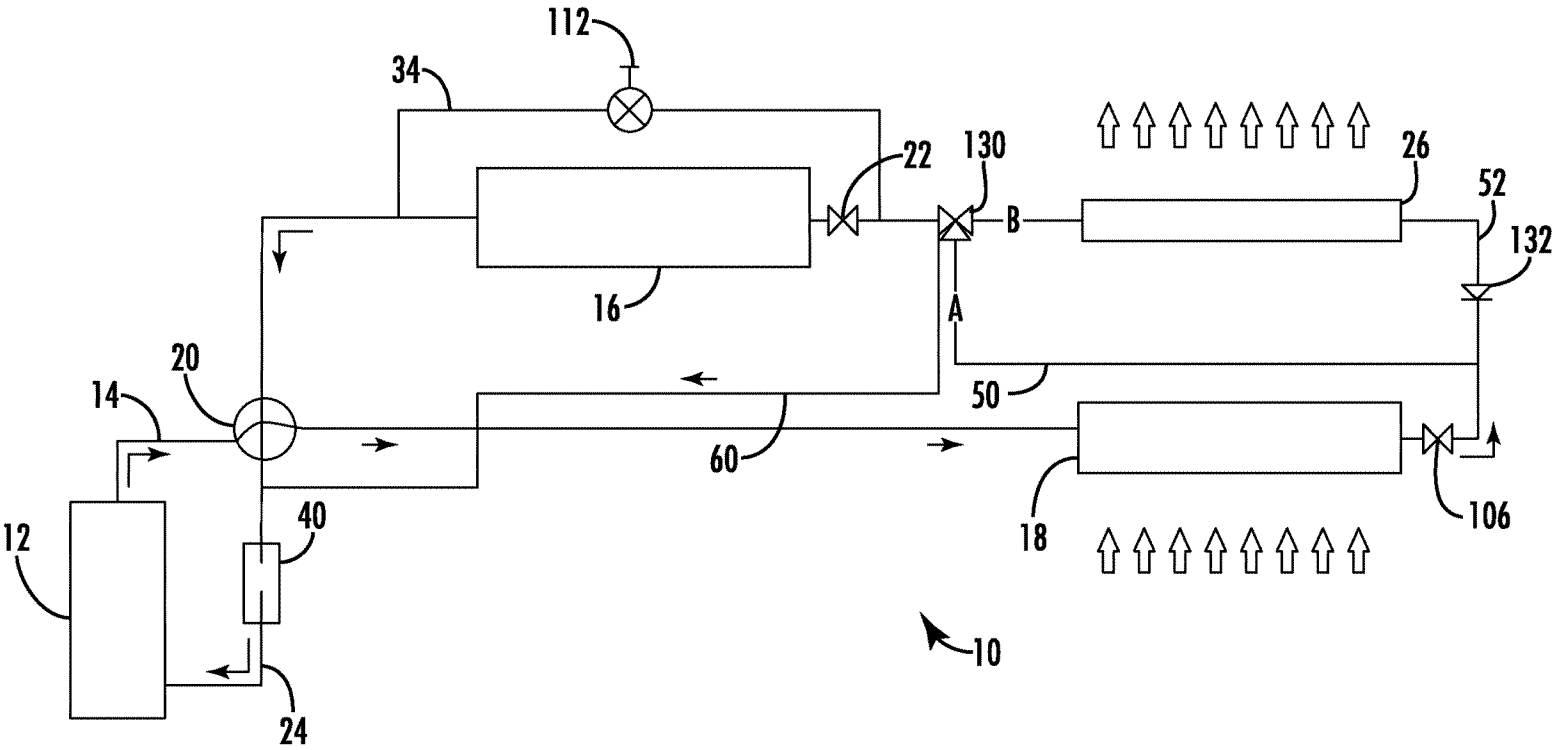
FIG. 8 illustrates a dehumidification system for a heat pump according to one embodiment of the present disclosure.

Referring now to FIGS. 7 and 8, in accordance with another embodiment of the present disclosure, the system 10 includes a bleed line 60 allowing refrigerant to bleed from line 52 at the reheat valve 130 to the suction line 24 upstream from the compressor 12. The bleed line 60 allows refrigerant to escape the line 52 and the reheat heat exchanger 26 such that the line 52 and/or reheat heat exchanger 26 do not retain an unknown amount of refrigerant, thereby allowing efficient and reliable operation of the system 10. In the cooling mode, illustrated in FIG. 7, the reheat valve 130 is opened to line 50 and closed to line 52. Refrigerant retained in the reheat heat exchanger 26 bleeds through the reheat valve 130 and the bleed line 60 to the suction line 24. Refrigerant bleeds through the bleed line 60 because, at the reheat valve 130 or in the line 52, the pressure of the refrigerant is significantly greater than the pressure in the suction line 24. The pressure differential forces flow of any refrigerant out of the line 52 toward the suction line 24. In the reheat mode, the reheat valve 130 is open to line 52 to allow refrigerant to circulate through the reheat heat exchanger 26 and closed to line 50. In the reheat mode, the reheat valve 130 is closed to the bleed line 60 to prevent refrigerant from circulating from the line 52 to the suction line 24. In the heating mode, as illustrated in FIG. 8, the reheat valve 130 is open to line 50 to allow refrigerant to flow through the indoor heat exchanger 18, bypass the reheat heat exchanger 26, flow through the reheat valve 130, and through the expansion device 22 and the outdoor heat exchanger 16. The refrigerant then flows through the flow control device 20 to the suction line 24. Refrigerant retained in the reheat heat exchanger 26 bleeds through the reheat valve 30 and the bleed line 60 to the suction line 24 in the heating mode illustrated in FIG. 8.

Figure 9:
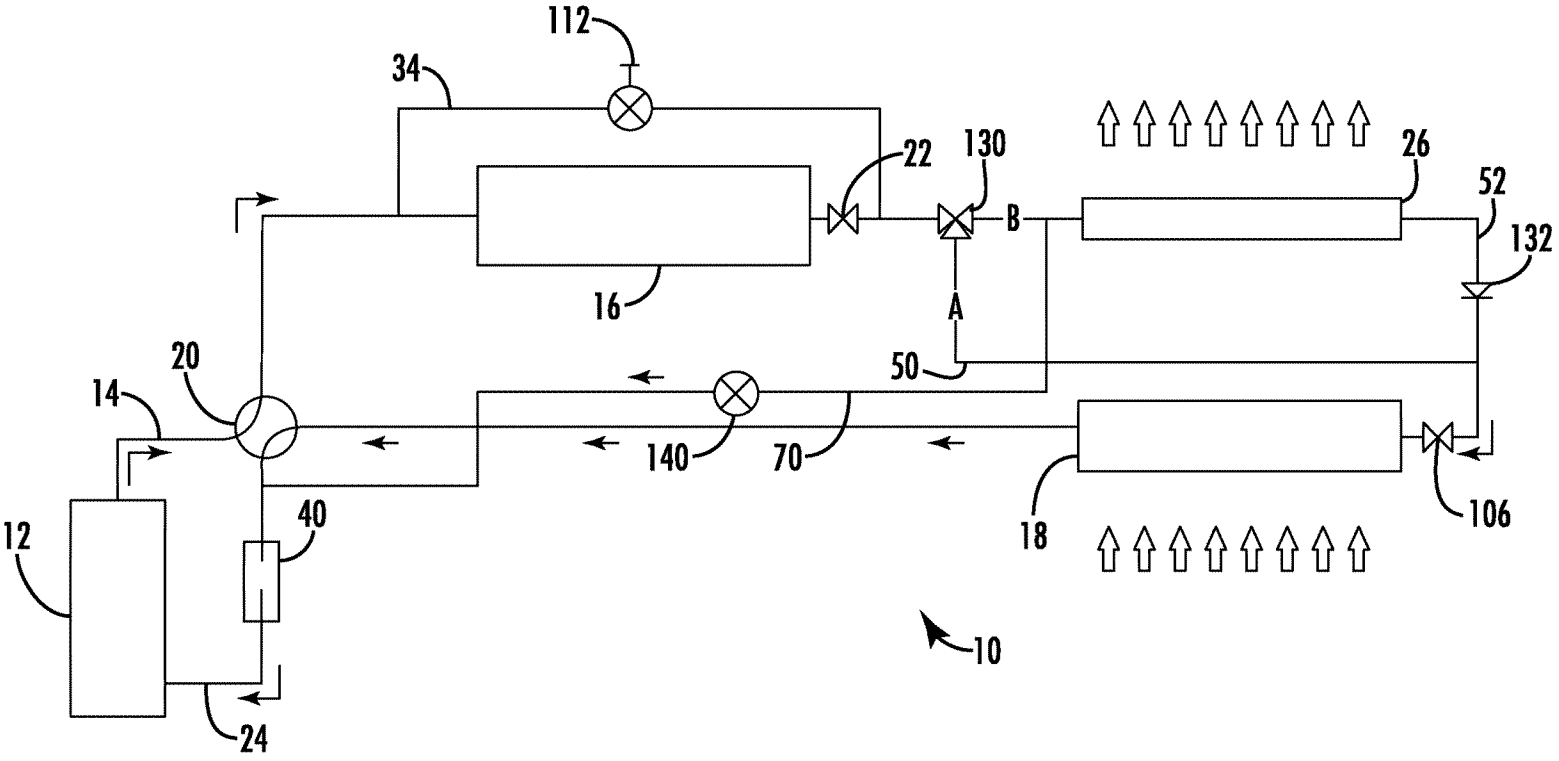
FIG. 9 illustrates a dehumidification system for a heat pump according to one embodiment of the present disclosure.
Figure 10:
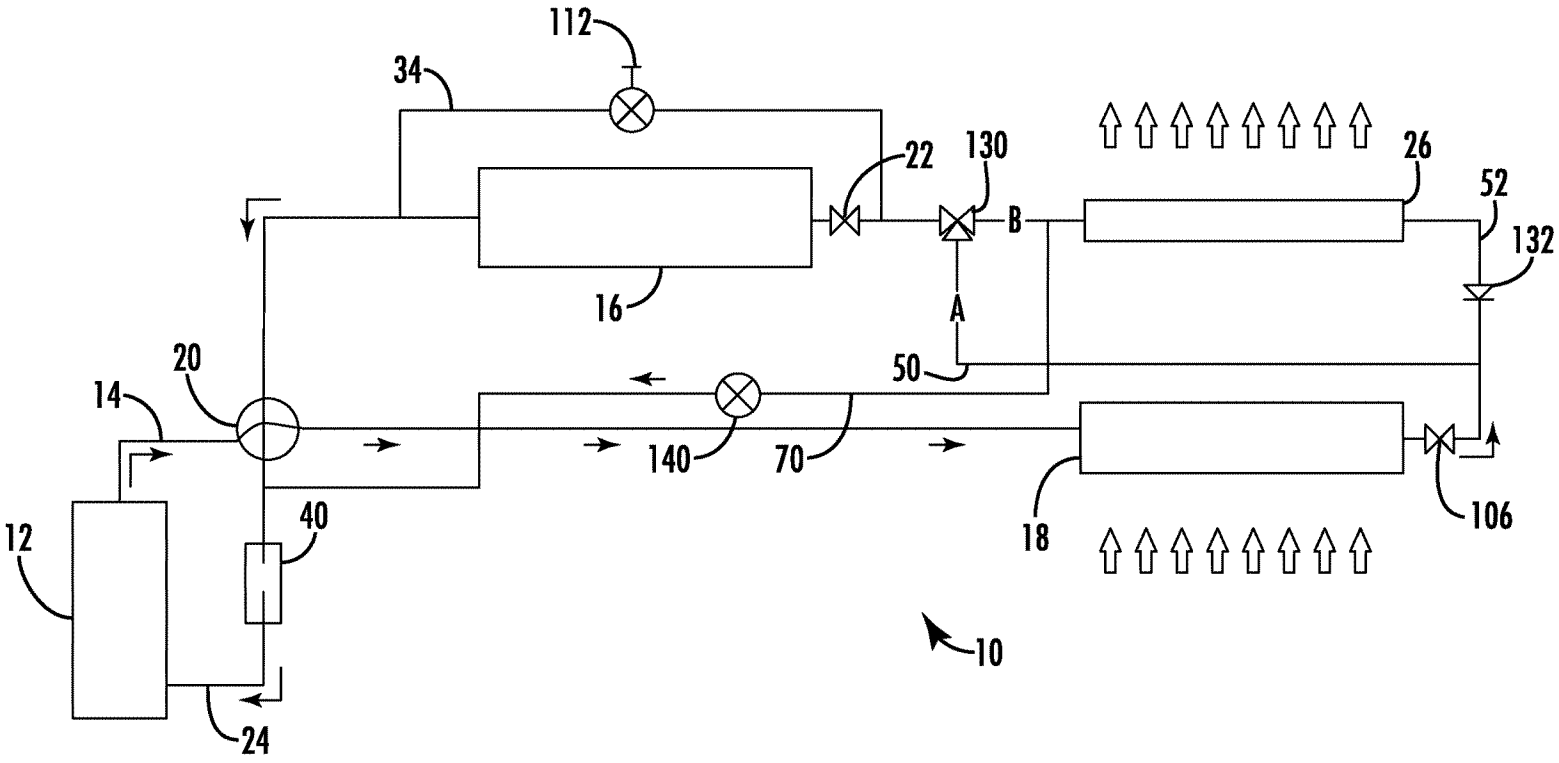
FIG. 10 illustrates a dehumidification system for a heat pump according to one embodiment of the present disclosure.

Referring now to FIGS. 9 and 10, in accordance with another embodiment of the present disclosure, the system 10 includes a bleed line 70 allowing refrigerant to selectively circulate or bleed from line 52 between the reheat valve 130 and the reheat heat exchanger 26 to the suction line 24 upstream from the compressor 12. Bleed valve 140 controls refrigerant circulation through the bleed line 70. In the cooling mode, illustrated in FIG. 9, the reheat valve 130 is opened to line 50 and closed to line 52. Bleed valve 140 is open in the cooling mode to allow refrigerant retained in the reheat heat exchanger 26 to bleed through the bleed line 70 to the suction line 24. In the reheat mode, the reheat valve 130 is open to line 52 to allow refrigerant to circulate through the reheat heat exchanger 26 and closed to line 50. In the reheat mode, the bleed valve 140 is closed to prevent refrigerant from flowing from the line 52 to the suction line 24. In the heating mode, as illustrated in FIG. 10, the reheat valve 130 is open to line 50 to allow refrigerant to circulate through the expansion valve 106 and bypass the reheat heat exchanger 26. Bleed valve 140 is open in the heating mode to allow refrigerant retained in the reheat heat exchanger 26 to bleed through the bleed line 70 to the suction line 24.

Figure 11:
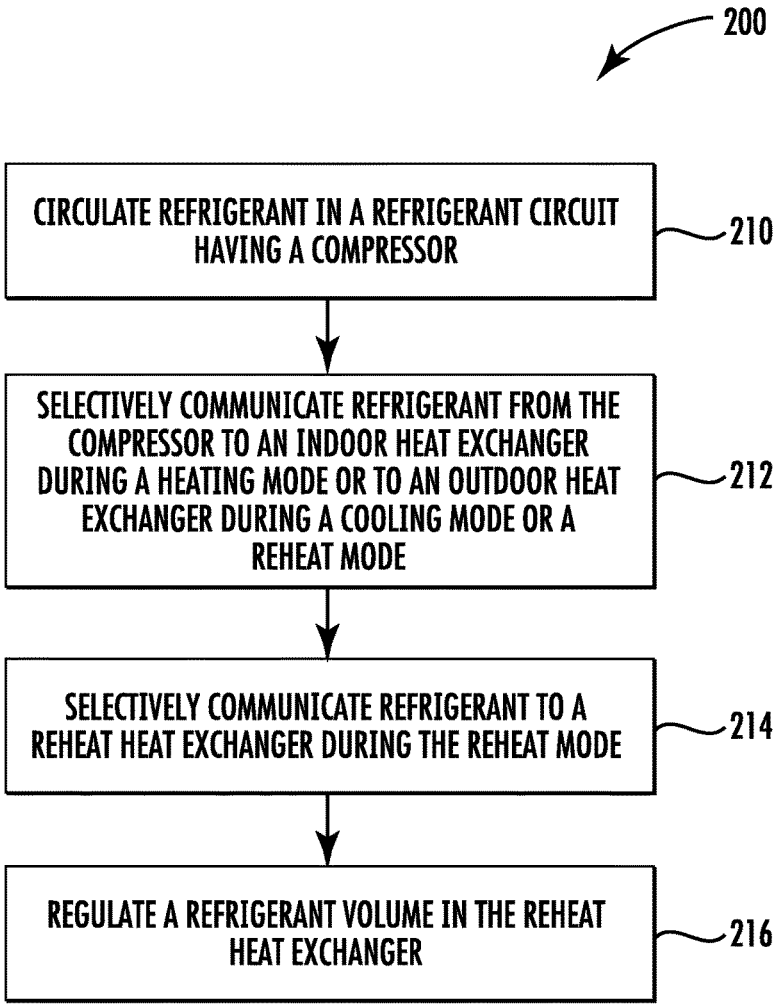
FIG. 11 illustrates a method of operating a heat pump system according to one embodiment of the present disclosure.

In accordance with the embodiment of the present disclosure illustrated in FIG. 11, a method 200 of operating the heat pump system 10 is provided. The method 200 includes the steps of circulating, in step 210, refrigerant in a refrigerant circuit having the compressor 12 and selectively communicating, in step 212, refrigerant from the compressor 12 to the indoor heat exchanger 18 during a heating mode or to the outdoor heat exchanger 16 during a cooling mode or a reheat mode. The method 200 further includes selectively communicating, in step 214, refrigerant to the reheat heat exchanger 26 during the reheat mode and regulating, in step 216, a refrigerant volume in the reheat heat exchanger 26.

The method 200 of one or more additional embodiments includes regulating the refrigerant volume by bypassing the reheat heat exchanger 26 after circulating refrigerant to the reheat heat exchanger 26 for the predetermined time period during the heating mode or the cooling mode, as described in detail above. Regulating the refrigerant volume in additional embodiments includes bleeding refrigerant from the reheat heat exchanger 26 during the heating mode or the cooling mode. In an embodiment, bleeding refrigerant from the reheat heat exchanger 26 includes bleeding refrigerant from the reheat heat exchanger 26 to a location upstream from the compressor 12, including, but not limited to, the suction line 24. The method 200 of one or more embodiments includes selectively bypassing the outdoor heat exchanger 16.

Figure 12:
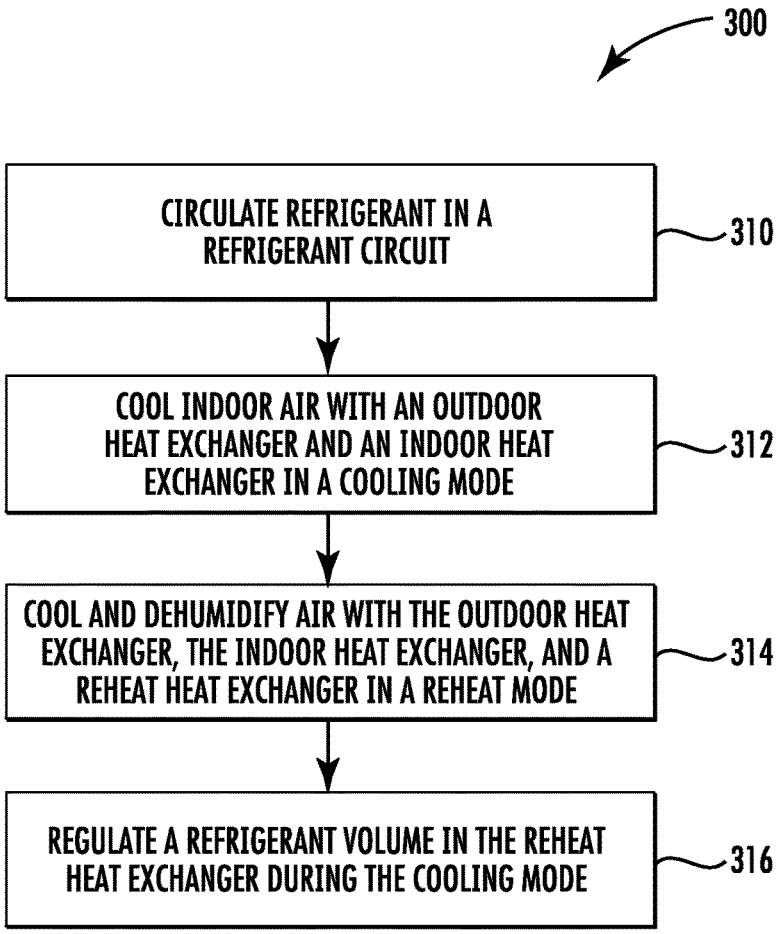
FIG. 12 illustrates a method of operating a refrigeration system according to one embodiment of the present disclosure.

Referring now to FIG. 12, in accordance with an embodiment of the present disclosure, a method 300 of operating a refrigeration system, such as the system 10, is provided. The method 300 includes the steps of circulating, in step 310, refrigerant in a refrigerant circuit and cooling, at step 312; indoor air with the outdoor heat exchanger 16 and the indoor heat exchanger 18 in a cooling mode. The method 300 further includes cooling and dehumidifying, at steps 314, air with the outdoor heat exchanger 16, the indoor heat exchanger 18, and the reheat heat exchanger 26 in a reheat mode and regulating, at step 316, a refrigerant volume in the reheat heat exchanger 26 during the cooling mode.

In one or more additional embodiments, regulating the refrigerant volume includes the refrigerant bypassing the reheat heat exchanger 26 after circulating refrigerant to the reheat heat exchanger 26 for the predetermined time period during the cooling mode. Regulating the refrigerant volume includes bleeding refrigerant from the reheat heat exchanger 26 in the cooling mode on one or more embodiments. Removing refrigerant from the reheat heat exchanger 26 includes bleeding refrigerant from the reheat heat exchanger 26 to a location upstream from the compressor 12, including, but not limited to, the suction line 24 in one or more embodiments.

The method 300 of additional embodiments further includes heating indoor air in the heating mode and regulating the refrigerant volume in the reheat heat exchanger 26 during the heating mode. Regulating the refrigerant volume in additional embodiments includes the refrigerant bypassing the reheat heat exchanger 26 after circulating refrigerant to the reheat heat exchanger 26 for the predetermined time period during the heating mode. Regulating the refrigerant volume in an embodiment includes removing refrigerant from the reheat heat exchanger 26 in the heating mode. The method 300 further includes selectively bypassing the outdoor heat exchanger 16.

It will be appreciated that the embodiments provided in the present disclosure provide an HVAC, heat pump, or refrigeration system 10 having a reheat function with enhanced control of a refrigerant volume being contained in or evacuated from the reheat heat exchanger 26. With control of the refrigerant volume, the system 10 and methods 200, 300 improve efficiency, reliability, and performance of the system 10 due to awareness and control of refrigerant circulating throughout the overall system 10.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A dehumidification system for a heat pump, the system comprising:

a compressor configured to circulate refrigerant in a refrigerant circuit;

an outdoor heat exchanger;

an indoor heat exchanger;

a flow control device for selectively routing refrigerant from the compressor to the indoor heat exchanger when in a heating mode or to the outdoor heat exchanger when in a cooling mode; and a reheat heat exchanger configured to receive refrigerant during a reheat mode and regulate a refrigerant volume during an initiation of the heating mode and the cooling mode;

wherein the reheat heat exchanger is configured to receive and store the refrigerant volume for a predetermined time period during the initiation of the heating mode or the cooling mode before refrigerant bypasses the reheat heat exchanger.

2. The system of claim 1, further comprising a bleed passage selectively communicating refrigerant from the reheat heat exchanger in the heating mode or cooling mode.

3. The system of claim 2, wherein the bleed passage selectively communicates refrigerant to a location upstream from the compressor.

4. A method of operating a heat pump system, the method comprising:

circulating refrigerant in a refrigerant circuit having a compressor;

selectively communicating refrigerant from the compressor to an indoor heat exchanger during a heating mode or to an outdoor heat exchanger during a cooling mode or a reheat mode;

selectively communicating refrigerant to a reheat heat exchanger during the reheat mode; and regulating a refrigerant volume in the reheat heat exchanger;

wherein regulating the refrigerant volume includes bypassing the reheat heat exchanger after receiving and storing the refrigerant volume for a predetermined time period during initiation of the heating mode or the cooling mode.

5. The method of claim 4, wherein regulating the refrigerant volume includes bleeding refrigerant from the reheat heat exchanger during the heating mode or the cooling mode.

6. The method of claim 5, wherein bleeding refrigerant from the reheat heat exchanger includes bleeding refrigerant from the reheat heat exchanger to a location upstream from the compressor.

7. The method of claim 4, further comprising selectively bypassing the outdoor heat exchanger.

8. A method of operating a refrigeration system, the method comprising:

circulating refrigerant in a refrigerant circuit;

cooling indoor air with an outdoor heat exchanger and an indoor heat exchanger in a cooling mode;

cooling and dehumidifying air with the outdoor heat exchanger, the indoor heat exchanger, and a reheat heat exchanger in a reheat mode; and regulating a refrigerant volume in the reheat heat exchanger during the cooling mode;

wherein regulating the refrigerant volume includes the refrigerant bypassing the reheat heat exchanger after receiving and storing the refrigerant volume for a predetermined time period during initiation of the heating mode or the cooling mode.

9. The method of claim 8, wherein regulating the refrigerant volume includes bleeding refrigerant from the reheat heat exchanger in the cooling mode.

10. The method of claim 9, wherein bleeding refrigerant from the reheat heat exchanger includes bleeding refrigerant from the reheat heat exchanger to a location upstream from a compressor.

11. The method of claim 8, further comprising:

heating indoor air in a heating mode; and regulating the refrigerant volume in the reheat heat exchanger during the heating mode.

12. The method of claim 11, wherein regulating the refrigerant volume includes the refrigerant bypassing the reheat heat exchanger after receiving and storing the refrigerant volume for a predetermined time period during initiation of the heating mode.

13. The method of claim 11, wherein regulating the refrigerant volume includes removing refrigerant from the reheat heat exchanger in the heating mode.

14. The method of claim 13, wherein removing refrigerant from the reheat heat exchanger includes bleeding refrigerant from the reheat heat exchanger to a location upstream from a compressor.

15. The method of claim 11, further comprising selectively bypassing the outdoor heat exchanger.

* * * * *